US008418271B2

(12) United States Patent
Hardy

(10) Patent No.: US 8,418,271 B2
(45) Date of Patent: Apr. 16, 2013

(54) PROTECTIVE EAR SHADES

(76) Inventor: Danny J. Hardy, LaPorte, TX (US)

( * ) Notice: Subject to any disclaimer, the term of this patent is extended or adjusted under 35 U.S.C. 154(b) by 50 days.

(21) Appl. No.: 12/862,502

(22) Filed: Aug. 24, 2010

(65) Prior Publication Data

US 2012/0047628 A1 Mar. 1, 2012

(51) Int. Cl.
*A42B 0/08* (2006.01)

(52) U.S. Cl.
USPC ..... 2/423; 2/172; 2/209; 2/209.13

(58) Field of Classification Search ..... 2/423, 172, 2/207, 209, 209.11, 209.13
See application file for complete search history.

(56) References Cited

U.S. PATENT DOCUMENTS

| | | | | | |
|---|---|---|---|---|---|
| 691,623 | A * | 1/1902 | Harris | 2/423 |
| 899,334 | A * | 9/1908 | Seitzman | 2/10 |
| 2,333,392 | A * | 11/1943 | Rosenzweig | 2/209 |
| 2,545,552 | A * | 3/1951 | Leeming | 2/209 |
| 3,144,663 | A * | 8/1964 | Mckinstry | 2/209 |
| 4,791,684 | A * | 12/1988 | Schwartz | 2/209 |
| 5,119,514 | A | 6/1992 | Woehl | |
| 5,121,507 | A * | 6/1992 | Brown | 2/172 |
| 5,125,113 | A | 6/1992 | Yun | |
| 5,339,467 | A * | 8/1994 | Brinkley | 2/209 |
| 5,426,790 | A * | 6/1995 | Robertson | 2/209.13 |
| 5,493,733 | A * | 2/1996 | Pospisil | 2/195.1 |
| D368,153 | S * | 3/1996 | Amey | D2/879 |
| 5,615,417 | A * | 4/1997 | Jackson | 2/209 |
| 5,689,831 | A * | 11/1997 | Harris | 2/209 |
| 5,898,945 | A * | 5/1999 | Weiser | 2/209 |
| 6,286,149 | B1 * | 9/2001 | Whitaker | 2/209 |
| 6,550,064 | B2 * | 4/2003 | Schmitt et al. | 2/10 |
| 6,912,733 | B2 * | 7/2005 | Carrafield et al. | 2/209 |
| 7,134,147 | B2 | 11/2006 | Yount | |
| 7,469,429 | B1 * | 12/2008 | Lanclos | 2/209 |
| 7,578,007 | B2 * | 8/2009 | McIntyre | 2/181.4 |
| D608,818 | S | 1/2010 | Kindl | |
| 7,865,974 | B1 * | 1/2011 | Heller | 2/209 |
| 8,060,950 | B1 * | 11/2011 | Thornton | 2/209 |
| 2005/0028250 | A1 * | 2/2005 | Zaic | 2/209 |
| 2006/0053530 | A1 * | 3/2006 | Yount | 2/209 |
| 2007/0245459 | A1 * | 10/2007 | Hillman-Schwartz et al. | 2/209 |

OTHER PUBLICATIONS

Legionnaires Africa CAP 11-70648—Neck shade & ear protector stiffened curve peak, ventilation eyelets, sun protection factor; printed Aug. 24, 2010 http://www.alibaba.com/product-gs/275419826/LEGIONNAIRESS_AFRICA_CAP_70648.html.

* cited by examiner

*Primary Examiner* — Khoa Huynh
*Assistant Examiner* — Sally Haden
(74) *Attorney, Agent, or Firm* — Gary L. Bush; Andrews Kurth LLP

(57) ABSTRACT

Left and right ear shades that are connectable to the bottom of an ordinary baseball cap, etc. Each ear shade removably attaches to the side of the hat and can be moved forward or backward along the hat to accommodate the wearer. Each ear shade includes an attachment member for releasably connecting the ear shade to the hat. Connected to the attachment member is an arcuate cover, which is ideally shaped to fit around the at least part of the back, the top, and part of the front of the ear. The cover extends laterally from the wearer's head to shade the ear. The attachment member may include an integral clip, a serrated projection, a wedge, or a tab and removable clip, for example.

6 Claims, 6 Drawing Sheets

PROTECTIVE EAR SHADES

BACKGROUND OF THE INVENTION

1. Field of the Invention

This invention relates generally to protection of the human body from prolonged exposure to the sun, and in particular to protection of the ears.

2. Background Art

The sun's ultraviolet rays can cause burning, peeling, and even blistering of one's skin. A person's ears are often uncovered and therefore subject to greater exposure. Although some hat designs with a wide brim do an acceptable job of shading the wearer's ears from the sun, the wide brim provides a large sail area and is therefore subject to being caught by the wind and blown from the wearer's head. Use of brimmed hats may be particularly annoying for golfers, for example, because the hat may be blown from a golfer's head every time he lowers his head to address the golf ball. On the other hand, brimless hats, such as the popular baseball cap, trucker hat, golf cap, and tennis visor, among others, provide no shade over the wearer's ears.

As shown in FIG. 1, a variant of the baseball cap, known as a legionnaire's cap, includes a fabric drape hanging from the bottom of the crown at the sides and back of the cap. This drape covers the wearer's neck and ears. Such caps have the tendency to reduce airflow around the wearer's head, so that the wearer may become uncomfortably warm. The drape may also diminish the wearer's hearing.

A cap that includes detachable front, side, and rear visors is disclosed in U.S. Pat. No. 5,125,113 issued to Yun on Jun. 30, 1992. However, these visors are bulky and cumbersome. Moreover, such visors require that the cap include snap fasteners for attachment of the visors to the cap. Accordingly, the Yun arrangement is not readily usable with off-the-shelf baseball caps, trucker hats, and the like.

3. Identification of Objects of the Invention

A primary object of the invention is to provide an apparatus for removable attachment to ordinary baseball caps, trucker hats and the like that shields the wearer's ears from excessive sunlight.

Another object of the invention is to provide an ear shade that is lightweight and unobtrusive.

Another object of the invention is to provide an ear shade that can be used with a variety of hats and can be quickly and easily installed and removed.

Another object of the invention is to provide an ear shade that is inexpensive.

Another object of the invention is to provide an ear shade that does not diminish the wearer's ability to hear.

Another object of the invention is to provide an ear shade that is attractive and that is secured to the inside of a hat so as to have minimal aesthetic effect on the exterior crown of the hat.

Another object of the invention is to provide an ear shade that is easily adjustable to accommodate the large variety shapes and sizes of wearers' heads and ears.

SUMMARY OF THE INVENTION

The objects described above and other advantages and features of the invention are incorporated in an ear shade that is connectable to the bottom of the crown of an ordinary prior art baseball cap, trucker hat, golf cap, or the like. The ear shade removably attaches to the side of the hat and can be moved forward or backward along the hat to accommodate the wearer and provide the most comfortable fit. Left and right ear shades are symmetric about a medial plane of the wearer.

The ear shade assists in blocking the sun's rays for the prevention of sunburn of the wearer's ear. The ear shade is preferably shaped and sized so as to cover the ear during the midday hours when the sun's ultraviolet rays are the most intense. Preferably, the ear shade covers the upper front, the top, and substantially the entire rear of the ear.

The ear shade includes an attachment member for releasably connecting the ear shade to the hat. Connected to the attachment member is an arcuate cover, which is shaped to fit around the back, top, and part of the front of the ear. The cover extends laterally from the wearer's head about one inch or so. The attachment member may include an integral clip, a serrated projection, a wedge, or a tab and removable clip, for example.

BRIEF DESCRIPTION OF THE DRAWINGS

The invention is described in detail hereinafter on the basis of the embodiments represented in the accompanying figures, in which:

FIG. 3A is a perspective view of a right-side ear shade according to a first embodiment of the invention, showing a short arcuate cover for shading an ear and a clip attachment member for securing the shade to the side of a baseball cap, trucker hat, or the like;

DESCRIPTION OF THE PREFERRED EMBODIMENT OF THE INVENTION

Figure 1:
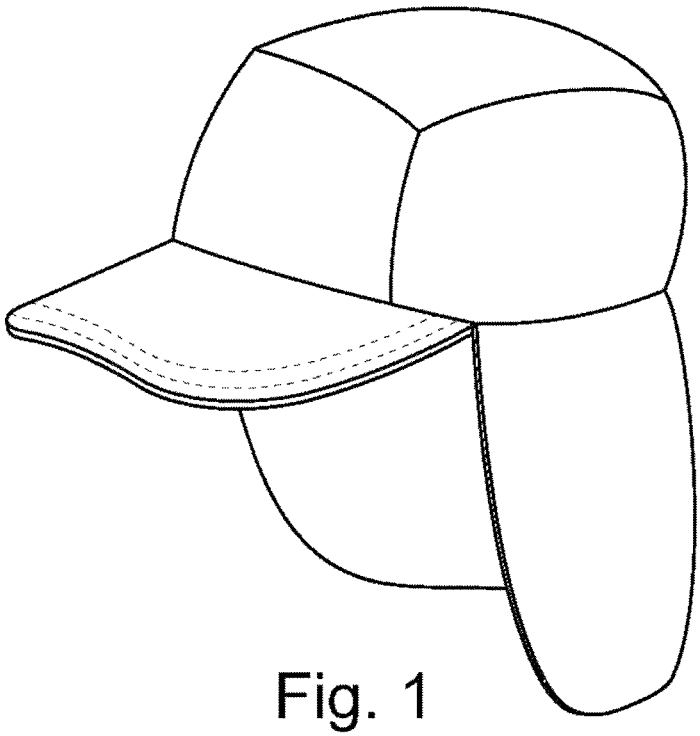
Fig. 1 (PRIOR ART)
FIG. 1 is a perspective view of a legionnaire cap of prior art, showing a drape sewn to the bottom of the cap crown from one end of the visor to the other end of the visor across the sides and back of the cap for covering a wearer's ears and neck.
Figure 2:
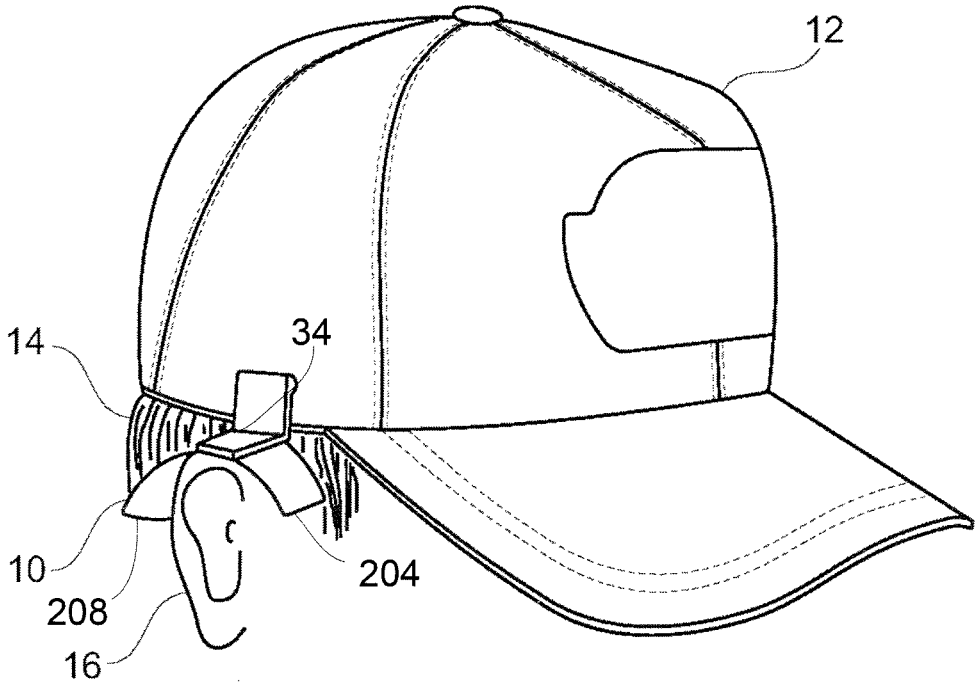
FIG. 2 is a perspective view of a right-side car shade connected to the bottom of the crown of baseball cap according to an embodiment of the invention.

FIG. 2 illustrates an ear shade 10 according to a first embodiment of the invention that is connected to the bottom of the crown of an ordinary prior art baseball cap 12, trucker hat, golf cap, or the like, and which is donned by a wearer 14. Ear shade 10 removably attaches to the side of cap 12 and can be moved forward or backward along the cap to accommodate wearer 14 and provide the most comfortable fit. FIG. 2 shows only an ear shade 10 that is adapted for covering a wearer's right ear 16, but left ear shades are included within the scope of the invention. For simplicity, only right ear shades are illustrated, with the understanding that left ear shades are symmetric about a medial plane of the wearer 14 to the right ear shades.

Ear shade 10 assists in blocking the sun's rays for the prevention of sunburn of the wearer's ear 16. Ear shade 10 is preferably shaped and sized so as to cover ear 16 during the midday hours when the sun's ultraviolet rays are the most intense. Ear shade 10 preferably shades the upper front, the top, and substantially the entire rear of ear 16 from the sun. More precisely, ear shade 10 is designed and arranged to be disposed anatomically superior to ear 16 extending anatomically laterally from adjacent the wearer's head to a point beyond the ear. Ear shade 10 extends anatomically anteriorly or rostally to cover an upper portion of the front of ear 16 and extends anatomically posteriorly or caudally to cover a least an upper portion, if not substantially the entirety, of the back of ear 16.

Ear shade 10 is preferably made of a molded polymer material, although other suitable materials may be used. Polymer materials allow ear shade 10 to be manufactured in various aesthetic colors, such as black, white, khaki, blue, etc. Various sizes of ear shades 10 may be made, such as large, medium, and small, for accommodating different wearers 14. Alternatively, a "one-size-fits-all" ear shade 10 may be manufactured, and each wearer 14 can trim the ear shade 10 with scissors to obtain a proper fit.

Figure 3A:
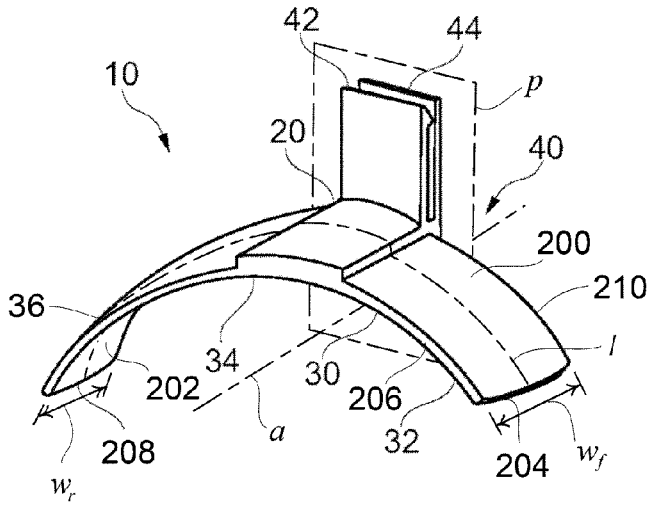
Figure 3D:
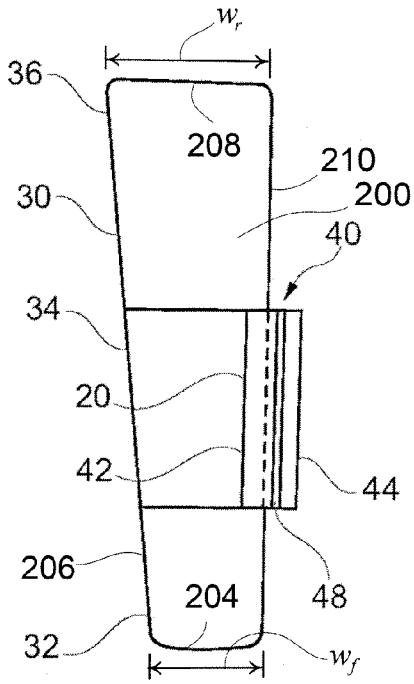
FIG. 3D is a plan view of the ear shade of FIG. 3A.
Figure 3B:
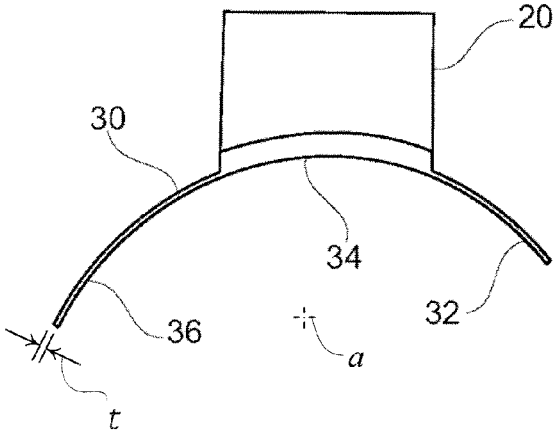
FIG. 3B is a right side view of the ear shade of FIG. 3A.
Figure 3C:
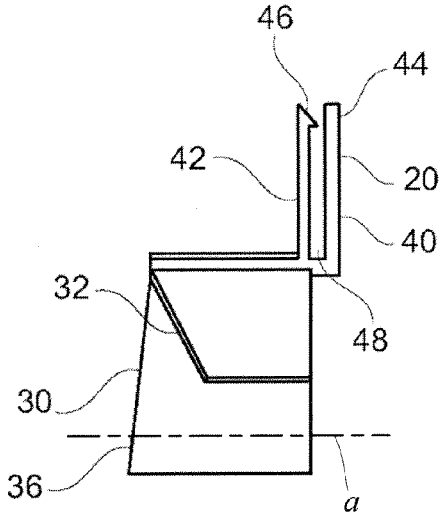
FIG. 3C is a front view of the ear shade of FIG. 3A.
Figure 4A:
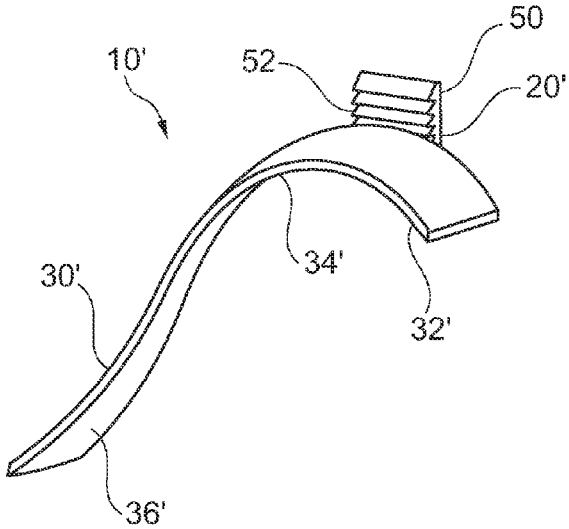
FIG. 4A is a perspective view of a right-side ear shade according to a second embodiment of the invention, showing a long lazy-"S"-shaped arcuate cover for shading an ear and a serrated attachment member for placement between the sweatband of a baseball cap, for example, and the wearer's head to hold the shade in place.
Figure 4D:
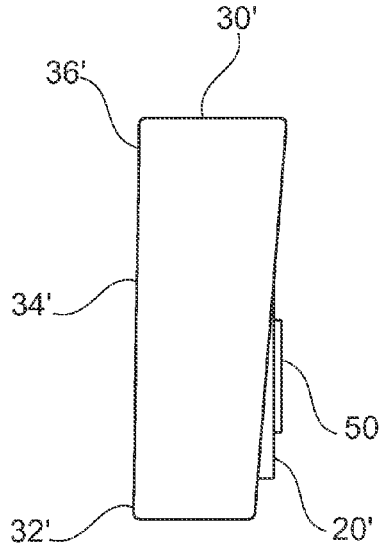
FIG. 4D is a plan view of the ear shade of FIG. 4A.
Figure 4B:
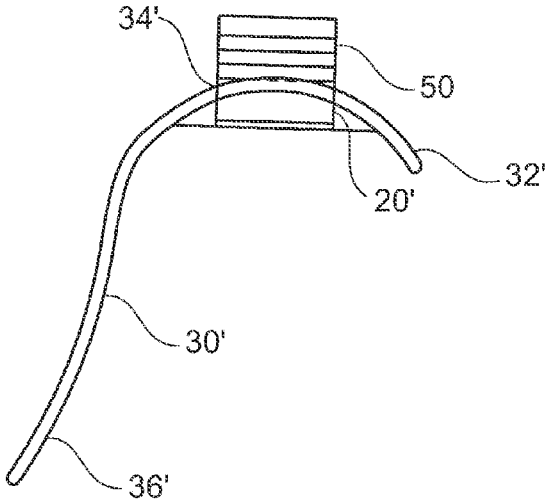
FIG. 4B is a right side view of the ear shade of FIG. 4A.
Figure 4C:
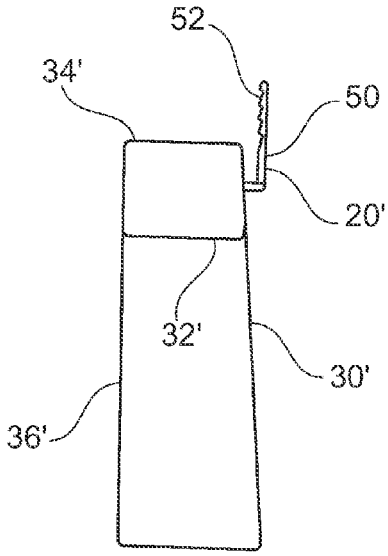
FIG. 4C is a front view of the ear shade of FIG. 4A.
Figure 5A:
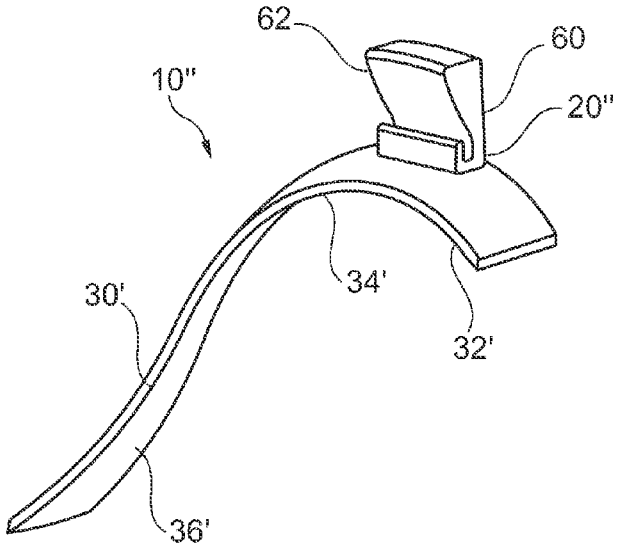
FIG. 5A is a perspective view of a right-side ear shade according to a third embodiment of the invention, showing an arcuate cover for shading an ear and a wedge attachment member for placement between the sweatband of a baseball cap, for example, and the wearer's head to hold the shade in place.
Figure 5D:
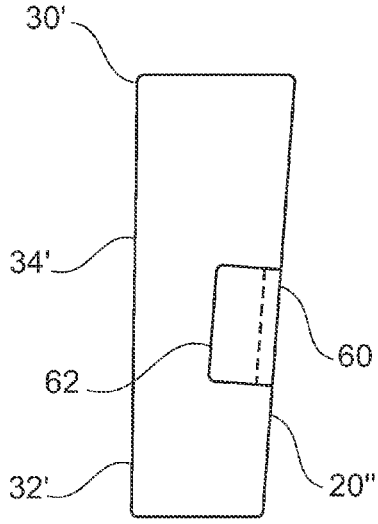
FIG. 5D is a plan view of the ear shade of FIG. 5A.
Figure 5B:
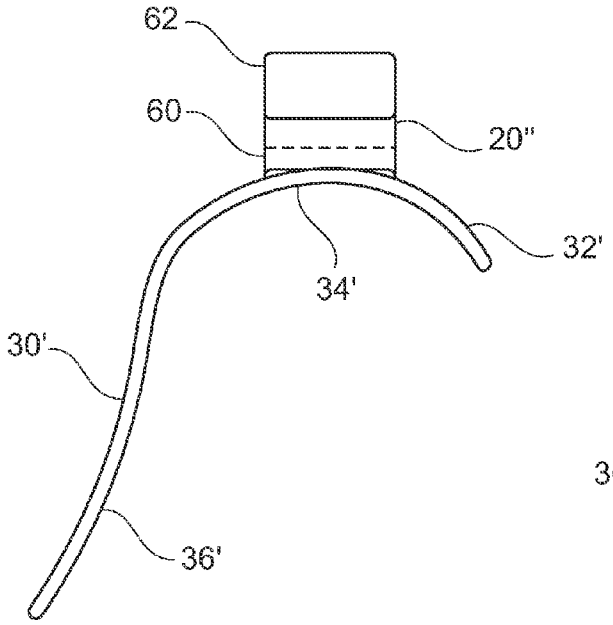
FIG. 5B is a right side view of the ear shade of FIG. 5A.
Figure 5C:
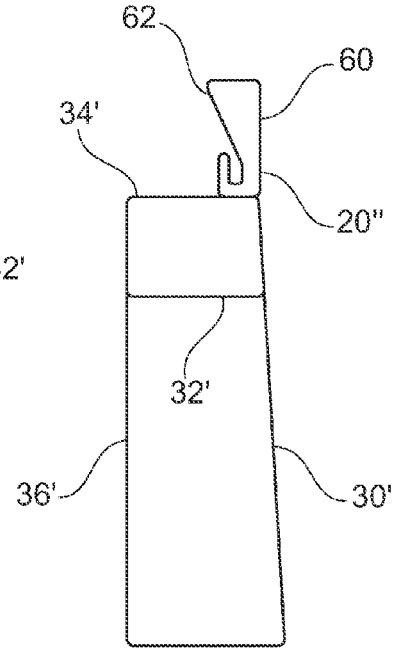
FIG. 5C is a front view of the ear shade of FIG. 5A.
Figure 6A:
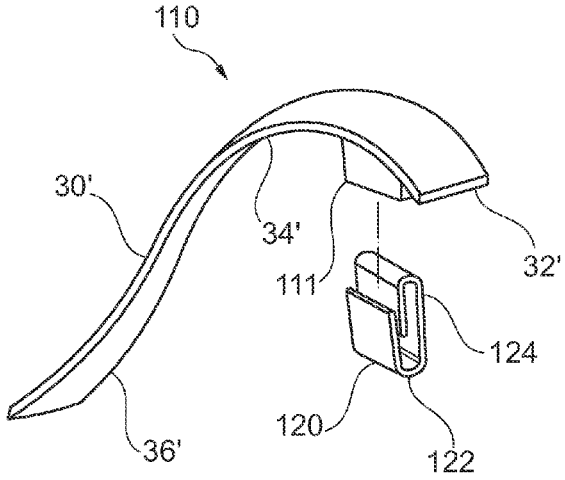
FIG. 6A is an exploded perspective view of a two-part right-side ear shade according to a fourth embodiment of the invention, showing a clip for connection to the sweatband of a ball cap, for example, and an arcuate cover for shading an ear with a downward-facing attachment tab for placement into the clip.
Figure 6D:
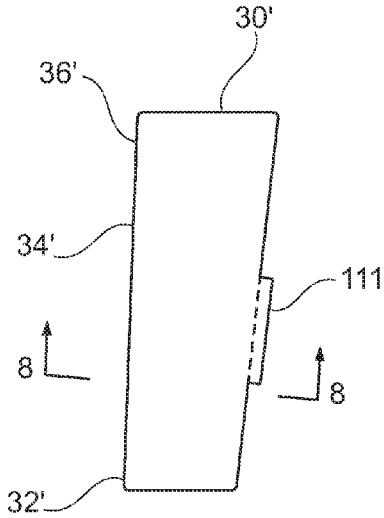
FIG. 6D is a plan view of the ear shade of FIG. 6A.
Figure 6B:
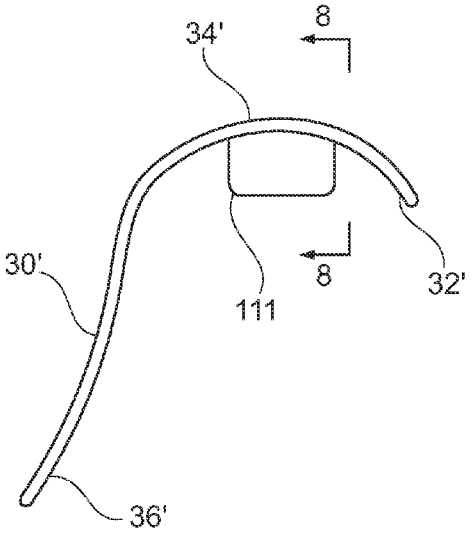
FIG. 6B is a right side view of the ear shade of FIG. 6A.
Figure 6C:
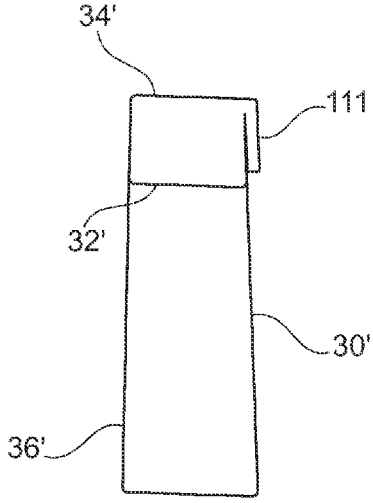
FIG. 6C is a front view of the ear shade of FIG. 6A.

FIGS. 3A-3D illustrate the right-side ear shade 10 of FIG. 2. Ear shade 10 includes an attachment member 20 for releasably connecting ear shade 10' to a cap 12 (FIG. 2). The portion of cap 12 to which attachment member 20 connects defines an imaginary reference plane p (FIG. 3A). Connected to attachment 20 is an arcuate cover 30, which is shaped to fit around the back, top, and part of the front of ear 16 (FIG. 2). In a preferred embodiment, cover 30 has a top surface 200 with at least a convex portion about an axis a (which is perpendicular to imaginary reference plane p) and a bottom surface 202 that is generally parallel to and separated from the top surface 200 by a thickness t. Top surface 200 and bottom surface 202 are each bounded by a front end 204 characterized by a front width $w_f$, an outer side edge 206, a rear end 208 characterized by a rear width $w_r$, and an inner side edge 210 so as to define a front or anterior portion 32, a middle superior portion 34, and a rear or posterior portion 36. As shown most clearly in FIGS. 3C and 3D, cover 30 maybe tapered such that rear portion 36 is wider than middle portion 34, which in turn is wider than front portion 32. In other words, front width $w_f$ may be greater than rear width $w_r$. This taper may extend laterally outward. Cover 30 defines a length l from front end 204 to rear end 208 as measured along top surface 200, as illustrated in FIG. 3A. Preferably, cover 30 extends laterally from the wearer's head about one inch or so and is dimensioned so that the front width $w_f$ and the read width $w_r$ are less than one-half the length l.

Cover 30 has a size and shape so that when ear shade 10 is attached to hat 12 and worn by wearer 14 (FIG. 2), middle portion 34 is disposed above (i.e. superior to) the wearer's ear 16 at a first elevation, the front end 204 is disposed in front of (anterior to) the wearer's ear 16 at a second elevation that is lower (inferior to) the first elevation, the rear end 208 is disposed behind (posterior to) the wearer's ear 16 at a third elevation that is lower (inferior to) the first elevation, and, although the cover 30 extends laterally from the wearer's head, no part of the cover is located directly outside (lateral) of ear 16.

Clip 40 is ideally disposed superiorly and medially to cover 30, which causes cover 30 to be located lower than the bottom edge of cap 12. However, clip 40 can be disposed inferiorly and medially with respect to cover 30 if desired to raise ear shade 10 with respect to the crown of cap 12.

Attachment 20 and cover 30 are ideally formed as a unitary structure. However, Attachment 20 and cover 30 may be formed separately and joined together if desired.

FIGS. 4A-4D illustrate a right-side ear shade 10' according to a second embodiment of the invention. Ear shade 10' includes an attachment member 20' for releasably connecting ear shade 10" to a cap 12 (FIG. 2). Connected to attachment 20' is a lazy-"S"-shaped arcuate cover 30', which is shaped to fit around the back, top, and part of the front of ear 16 (FIG. 2). Cover 30' extends laterally from the wearer's head about one inch or so. Cover 30' includes a front or anterior portion 32', a middle superior portion 34', and a rear or posterior portion 36'. Rear portion 36' has a slight curvature opposite to the curvature of middle portion 34' and extends further downward as compared to rear portion 36 of cover 30 of FIGS. 3A-3D. The longer rear portion 36' provides greater coverage of ear 16. As shown most clearly in FIGS. 3C and 3D, cover 30 may be tapered such that rear portion 36 is wider than middle portion 34, which in turn is wider than front portion 32. This taper may extend medially inward to conform with the shape of the wearer's head.

Attachment 20' includes a single, generally planar upward projection 50 disposed medially of cover 30'. Projection 50 is preferably serrated with a number of barbs 52 on its lateral side. Projection 50 is designed to be inserted between the head of wearer 14 and the inside lower edge of the crown (usually the sweatband) of cap 12. The elastic fit of cap 12 on the head of wearer 14 holds projection 50 firmly in place. The serrated lateral face of projection 50 helps keep ear shade 10' in the desired location. This embodiment has the aesthetic advantage of having a minimal portion of attachment 20' visible on the outside of hat 12.

Unlike attachment 20 of the embodiment of FIGS. 3A-3D, which is located entirely superior to cover 30, attachment 20' of FIGS. 4A-4D is located partially superior to cover 30'. However, the lower half of attachment 20' is disposed inferior to the middle portion 34' of cover 30'. This arrangement causes cover 30' to be located slightly above the bottom edge of cap 12 to provide greater clearance above the wearer's ear 16.

Attachment 20' and cover 30' may be formed as a unitary structure or may be formed separately and joined together.

FIGS. 5A-5D illustrate a right-side ear shade 10" according to a third embodiment of the invention. Ear shade 10" includes an attachment member 20" for releasably connecting ear shade 10" to a cap 12 (FIG. 2). Connected to attachment 20" is a lazy-"S"-shaped arcuate cover 30', which is described above with respect to ear shade 10' of FIGS. 4A-4D.

Attachment 20" includes a upward projection 60 disposed medially of cover 30'. Projection 60 includes a downward-tapered laterally-projecting wedge 62. Wedge 62 is designed to be inserted between the head of wearer 14 and the inside of the crown of cap 12. The elastic fit of cap 12 on the head of wearer 14 holds wedge 62 firmly in place. This embodiment has the aesthetic advantage of having a minimal portion of attachment 20" visible on the outside of hat 12.

Like attachment 20 of the embodiment of FIGS. 3A-3D, attachment 20" is located entirely superior to cover 30'. However, wedge 62 can be disposed inferiorly and medially with respect to cover 30' if desired to raise ear shade 10" with respect to the crown of cap 12.

Attachment 20" and cover 30' may be formed as a unitary structure or may be formed separately and joined together.

FIGS. 6A-6D illustrate a right-side two-part ear shade 110 according to a fourth embodiment of the invention. Ear shade 110 includes a lazy-"S"-shaped arcuate cover 30', which is described above with respect to ear shade 10' of FIGS. 4A-4D. A downward-facing attachment tab 111 is disposed medially and inferiorly to the middle portion 34' of cover 30'. Tab 111 is preferably molded integrally with cover 30'. A separate clip 120 (FIG. 6A) is provided that is carried by the sweatband of cap 12. Clip 120 includes a hook 122 that defines a channel 123 for receiving and supporting tab 111 therein.

Figure 7:
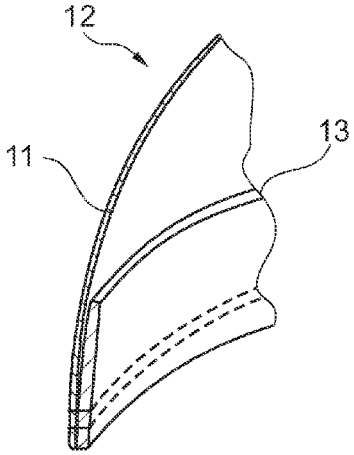
Fig. 7 (PRIOR ART)
FIG. 7 is a cutaway cross-section of a side portion of a typical ball cap of prior art, showing the construction of the bottom of the crown including an interior sweatband.
Figure 8:
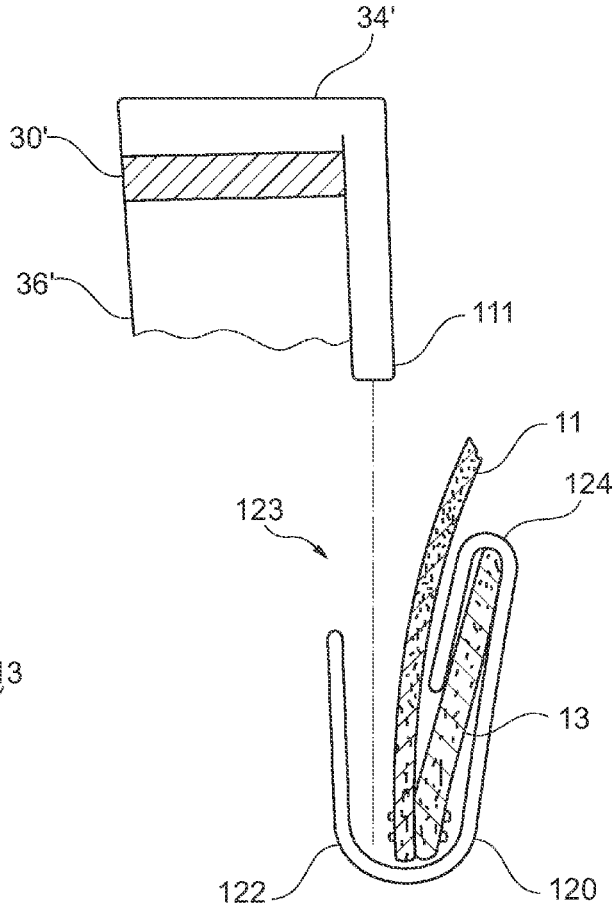
FIG. 8 is a detailed exploded cross-section of the ear shade of FIGS. 6A-6D taken along lines 8-8 of FIGS. 6B and 6C, showing the installation of the ear shade on the ball cap of FIG. 7.

The installation of ear shade 110 on cap 12 (FIG. 2) is discussed with reference to FIGS. 7 and 8. FIG. 7 is a cutaway cross-section of the lower side portion of the crown of prior art cap 12. The crown of cap 12 includes an exterior fabric or mesh covering 11. Sewn along the interior bottom edge of the crown is a sweatband 13. Clip 120 defines a medial upper hook 124 that hooks over the upper edge of sweatband 13 and extends between the fabric crown 111 and the inside of sweatband 13, thus securing clip 120 to hat 12. Clip 120 also defines a lateral lower hook 122, which provides a channel 123 between clip 120 and the exterior fabric surface of the crown of cap 12 into which tab 111 is received and supported. The dimensions of hook 120 is such that tab 111 has a snug fit within channel 123.

The Abstract of the disclosure is written solely for providing the United States Patent and Trademark Office and the public at large with a way by which to determine quickly from a cursory reading the nature and gist of the technical disclosure, and it represents solely a preferred embodiment and is not indicative of the nature of the invention as a whole.

While some embodiments of the invention have been illustrated in detail, the invention is not limited to the embodiments shown; modifications and adaptations of the above embodiment may occur to those skilled in the art. Such modifications and adaptations are in the spirit and scope of the invention as set forth herein:

What is claimed is:

1. A shade (10), specifically designed and arranged for releasably connecting to a hat of a wearer for protecting said hat wearer's ear (16) from sunlight, said hat comprises a crown having a circumferential bottom, said shade comprising:

an attachment (20) designed and arranged for releasable connection to said wearer's hat (12);

said attachment comprising a vertical portion and a horizontal portion, said vertical portion is specifically designed for releasably connecting to said bottom of said crown; and an arcuate cover (30) comprising a strip of material coupled to said horizontal portion of said attachment (20), said cover having a top surface (200) characterized by a convexity and a bottom surface (202) that is generally parallel to and separated from said top surface by a thickness (t), said top surface and said bottom surface each bounded by a front end (204) defining a first width (wf), an outer side edge (206), a rear end (208) defining a second width (wr), and an inner side edge (210), said cover defining a length (l) from said front end to said rear end as measured along said top surface, said cover characterized by said first width and said second width each being less than one half of said length and said front end is designed to be offset from said rear end;

said horizontal portion extends from said inner side edge of the cover to said outer side edge of the cover, said horizontal portion of said attachment has a width contiguous with the outer side edge of the cover and the inner side edge of the cover; wherein said shade (10) is characterized by a size and shape such that when said vertical portion of said attachment (20) is affixed directly to the bottom of said crown of said wearer's hat (12), and the circumferential bottom of the crown of the hat is configured to be parallel to the ground when the hat is worn by a wearer, a portion of said convexity is disposed directly above said wearer's ear at said horizontal portion of said attachment and defining a first elevation, said front end is disposed in front of said wearer's ear at a front elevation that is designed to be offset from and below said first elevation, said rear end is disposed to the rear of said wearer's ear at a rear elevation that is designed to be offset from and below both said first elevation and said front elevation, and no portion of said cover is disposed directly laterally of said wearer's ear.

2. The shade (10) of claim 1 wherein:

when said attachment (20) is connected to the bottom of the crown of said wearer's hat (12), said cover (30) extends laterally of said attachment (20).

3. The shade (10) of claim 2 wherein:

said first width is greater than said second width; whereby said cover (30) is tapered so that when said attachment (20) is connected to the bottom of the crown of said wearer's hat (12), the cover (30) extends further laterally as it extends caudally.

4. The shade (10') of claim 1 wherein:

said cover (30') is tapered so that when said attachment (20') is connected to the bottom of the crown of said wearer's hat (12), the cover (30') extends further medially as it extends caudally to conform with the shape of the head of said wearer (14).

5. The shade (10) of claim 1 wherein:

said cover (30) and said attachment (20) are integrally formed.

6. The shade (10) of claim 1 wherein:

said attachment (20') includes a clip (40) having first and second tines (42, 44) for receiving and holding a portion of the bottom of the crown of said wearer's hat (12) therebetween.

* * * * *